US006168042B1

(12) United States Patent
Kalagian

(10) Patent No.: US 6,168,042 B1
(45) Date of Patent: Jan. 2, 2001

(54) CUP WITH ATTACHED STRAW

(76) Inventor: Maureen Kalagian, 434 Clinton Pl. #603, River Forest, IL (US) 60305

( * ) Notice: Under 35 U.S.C. 154(b), the term of this patent shall be extended for 0 days.

(21) Appl. No.: 09/129,939

(22) Filed: Aug. 6, 1998

(51) Int. Cl.[7] ..... A47G 19/22; G09F 3/00

(52) U.S. Cl. ..... 220/705; 40/306; 206/217; 206/459.5; 215/383; 220/710; 229/103.1; 229/116.1; 229/922

(58) Field of Search ..... 220/710, 705; 229/103.1, 136, 922, 116.1, 116.4, 116.5; 239/33; 215/388, 383; 206/217, 459.5; 40/310, 306, 312; 283/56, 901, 903

(56) References Cited

U.S. PATENT DOCUMENTS

| | | | | |
|---|---|---|---|---|
| 1,213,961 | | 1/1917 | Shepard . | |
| 2,013,475 | * | 9/1935 | Orton | 215/388 X |
| 2,395,734 | * | 2/1946 | Georgeopoulos | 229/103.1 |
| 2,885,134 | * | 5/1959 | Cohen | 229/103.1 X |
| 3,306,521 | * | 2/1967 | Giacovas | 229/136 |
| 3,332,567 | | 7/1967 | Pugh . | |
| 3,349,987 | * | 10/1967 | Weitzner | 215/388 X |
| 3,445,033 | * | 5/1969 | Sweet et al. | 215/388 X |
| 3,774,804 | | 11/1973 | Henning . | |
| 3,780,944 | * | 12/1973 | Zubalik | 229/103.1 X |
| 3,880,281 | * | 4/1975 | Taddei | 206/217 |
| 3,921,889 | | 11/1975 | Gibbons . | |
| 4,203,240 | * | 5/1980 | Goodwin | 283/56 X |
| 4,247,016 | * | 1/1981 | Shaw | 229/103.1 X |
| 4,573,631 | | 3/1986 | Reeves . | |
| 4,830,204 | | 5/1989 | Lin . | |
| 5,052,614 | * | 10/1991 | Xuan | 229/103.1 |
| 5,199,633 | | 4/1993 | Jantzen . | |
| 5,460,264 | * | 10/1995 | Rupert | 220/710 X |
| 5,525,383 | * | 6/1996 | Witkowski | 206/217 X |
| 5,722,219 | * | 3/1998 | Dobransky | 229/103.1 X |
| 5,992,892 | * | 11/1999 | Schaefer et al. | 283/901 |

* cited by examiner

*Primary Examiner*—Allan N. Shoap
*Assistant Examiner*—Joe Merek
(74) *Attorney, Agent, or Firm*—Patula & Associates

(57) ABSTRACT

A drinking device comprising a cup and a straw selectively attached to the said cup at an upper end along the rim thereof, thus allowing a plurality of the cups, with attached straws, to be stackable. The straw can be selectively removed for use.

3 Claims, 3 Drawing Sheets

56
58
60
6
6
6
62
62
64
66
68
70
72
74
76

CUP WITH ATTACHED STRAW

BACKGROUND OF THE INVENTION

1. Field of the Invention

The instant invention relates generally to a cup and a straw attached thereto for drinking liquids from said cup.

The instant invention provides a cup with an accordion straw releasably attached to the exterior, thereof, and adjacent to the mouth of the cup. A consumer may grasp the cup, remove the straw from the exterior of the cup and insert the straw into a liquid contained by the cup. The consumer is, thereby, afforded an inexpensive means of drinking from the cup without raising the cup to the consumer's lips.

2. Description of the Related Art

Containers have long been employed to hold liquids to allow drinking therefrom. Such containers are typically referred to as cups. Drinking from said cups has traditionally been accomplished by raising of the cup to the lips of the person desiring to drink, therefrom, and, then, pouring of the liquid from the cup into the mouth of the person.

It has been found, however, that while some persons wish to drink from a cup, they find raising a cup their lips either undesirable or unacceptable. Some persons may find it crass or unfashionable to raise a cup to their lips. Others may be concerned about the sanitary nature of the cup. Still others have found placing a cup against their lips unacceptable for cosmetic reasons. By way of example, persons in the modeling or entertainment industry spend long work days with their lips covered with a cosmetic of some sort. While such persons would be desirous of a drink from a cup, they wish to minimize any alteration to the cosmetic covering caused by transporting the liquid to their mouth.

It has been found advantageous to persons drinking from such cups to employ a hollowed cylindrical object to transport suction from the person's mouth to below the surface of the liquid contained in the cup. Such hollowed cylindrical objects are typically referred to as straws. The straw, thereby, transports the liquid in the cup to the person's mouth without the cup being lifted to the mouth. Contact between the cup and the person's mouth and lips may thereby be avoided by one wishing to drink therefrom. In this manner, contact with person's lips is minimized to a small straw.

Persons who are concerned about the sanitary nature of such cups and straws for medical reasons (such as not being able to bend back the neck to drink after neck surgery) do not desire to clean the same, have been found to desire cups having an associated straw to allow the use of a new straw with each new cup. In this manner, such cup and straw combinations may be used as disposable objects, and a new cup and straw combination obtained whenever a drink is desired.

Prior attempts at providing a cup with an associated straw have produced complicated and cumbersome devices which are expensive and inconvenient to use. The high cost of such attempts eliminates the possibility of such combinations being disposable. Furthermore, the simplicity of use desired by those who wish to use a straw is also eliminated.

U.S. Pat. No. 1,213,961 to Shepard represents one prior attempt at a cup and straw combination. However, Shepard shows a straw which is integrally formed into a cup. This raises costs of manufacture and does not allow for maintaining the straw of Shepard in a clean or sanitary condition.

U.S. Pat. No. 3,332,567 to Pugh represents another attempt at a cup and straw combination. The teachings of Puqh require a cup to have a groove formed therein along the length and bottom thereof. The costs of manufacturing the Puqh cup become high and prohibit the application to a disposable type application.

U.S. Pat. No. 3,774,804 to Henning represents another attempt at a cup and straw combination. Henning teaches a very intricate construction to provide a straw integrally formed in a cup. As with the above discussed art, the costs of manufacture of the cup of Henning become prohibitive.

U.S. Pat. No. 3,921,889 to Gibbons represents another attempt at a cup and straw combination. Gibbons also shows a cup with an integrally formed straw. The costs of construction of Gibbons prohibit disposable applications.

U.S. Pat. No. 4,573,631 to Reeves represents another attempt at a cup and straw combination. Reeves shows a cup having a compartment formed on a side thereof for containing a straw. The elaborate construction of Reeves is expensive and prohibits disposable applications.

U.S. Pat. No. 4,830,204 to Lin represents another attempt at a cup and straw combination. Lin shows a straw integrally formed into a cup and an extension of the straw extending beyond the rim of the cup for drinking therefrom. The integral formation of the straw of Lin to the cup requires expensive manufacturing. Furthermore, the formation of the extension of Lin onto the straw portion integrally formed to the cup requires manufacturing techniques which prohibit a disposable application of the cup. Additionally, the construction of Lin does not provide for a means of protecting the straw from dirt, debris, or germs.

U.S. Pat. No. 5,199,633 to Jantzen et al. represents another attempt at a cup and straw combination. Jantzen et al. provides a cup which allows drinking from the bottom, thereof, through a straw inserted in a hole in the outer wall of the cup. The straw is not attached to the cup of Jantzen et al. for use therewith; rather it is merely inserted into the hole in the cup. Furthermore, the straw of Jantzen et al. provides no means of keeping the straw clean and sterile, and avoiding leakage of a liquid.

It is therefore an object of the instant invention to provide a cup and straw combination which is easy to use.

It is a further object of the instant invention to provide a cup and straw combination which is of simple construction.

It is a further object of the instant invention to provide a cup and straw combination which is inexpensive to produce and transport to customers.

It is a further object of the instant invention to provide a cup and straw combination which keeps the straw sanitary until ready for use.

It is a further object of the instant invention to provide a cup and straw combination which would have a multitude of uses, which include, by way of example only, fast food restaurants, eat in or carry out restaurants, picnics, cocktail parties, birthday parties, graduation parties, hospitals, retirement homes, airlines, and most other social occasions.

SUMMARY OF THE INVENTION

The above and other objections of the instant invention are accomplished by providing a cup with an attached straw. A cup is provided having a mouth into which liquids may be placed and out of which liquids may be extracted. It is often desirable to drink liquids from a cup through a straw rather than from the mouth of the cup.

The present invention is comprised of a straw having at least one accordion section. The accordion section allows for flexibility of the straw. Therefore, the straw may be bent for drinking from the cup. The straw may also be bent to conform to the outer perimeter of the cup, thus allowing attachment of the straw to the cup as described hereinbelow.

A string of beads of a pressure sensitive adhesive is preferably but selectively positioned on the cup. The straw is positioned in the beads of a pressure sensitive adhesive to selectively fix the straw to the cup. Consequently, a consumer gets a fresh unused straw with each cup. The concerns about alocating a straw or the cleanliness of such straw is thereby eliminated. Additionally, a cup and attached straw may be manufactured at a cost low enough to offer the cup and straw combination as a disposable good.

In order to facilitate easy and efficient stacking of the cup with the attached straw of the present invention, the straw is preferably attached to the exterior perimeter of the cup immediately adjacent to the mouth thereof. However, the present invention comprises attachment of the straw at any location on the cup consistent with the present invention as described below.

To further assure the cleanliness of the straw attached to the cup, the straw may alternatively have a packaging enclosing the straw from the environment such that the straw reaches the consumer untouched. Selective attachment to the cup is accomplished by attaching the packaging of the straw to the pressure sensitive adhesive.

Alternatively, the present invention may be practiced, for example, by detachably securing the straw of the present invention to a bottle or can rather than the cup of the present invention. Thus, consumer goods such as soda pop, beer, or spring water may be provided to consumers with the advantages of the straw of the present invention.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENTS OF THE PRESENT INVENTION

Figure 1:
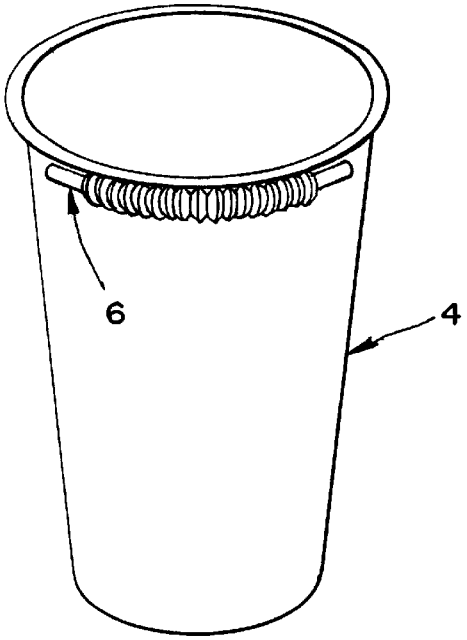
FIG. 1 depicts a perspective view of a first embodiment of a cup with an at ached straw of the present invention.

While the invention is susceptible of embodiment in many different forms, there is shown in the drawings and will be described herein, in detail, the preferred embodiments of the invention. It should be understood, however, that the present disclosure is to be considered an exemplification of the principles of the invention and is not intended to limit the spirit and scope of the invention and/or claims of the embodiment illustrated.

Figure 2:
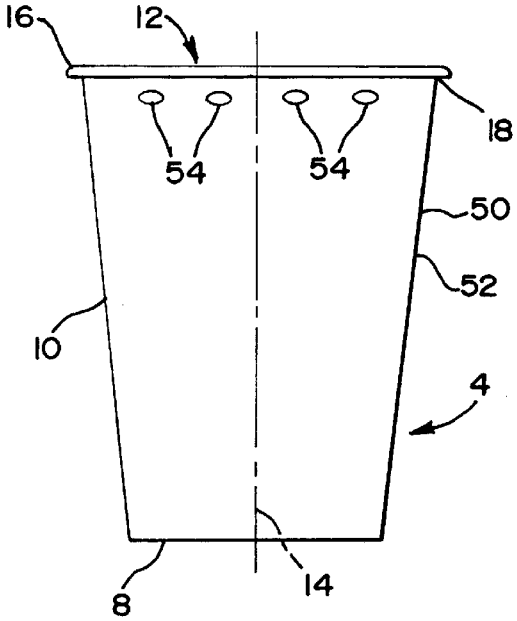
FIG. 2 depicts a front view of a cup of the present invention.

FIG. 1 depicts the preferred cup with attached straw of the present invention 2 comprising a preferred cup 4 and a preferred straw 6. The preferred cup 4 of the present invention as depicted in FIGS. 1 and 2 comprises a base 8 which forms the bottom of the cup 4 and, preferably, comprises a flat portion of the cup 4 on which to rest the cup 4 wherein the cup 4 is based to a position which will retain a liquid placed therein. At least one sidewall 10 extends upward from an outer diameter of the base 8 to form a mouth 12 of said cup 4. The present invention may be accomplished with the sidewall 10 extending from the base 8 at almost any angle to the base 8 that is desired. The sidewall 10 could, for example, even slant inward (not shown) toward said mouth 12 to form the mouth 12 to be smaller than the base 8. Furthermore, the preferred base 8 and sidewall 10 are depicted as circular about a vertical axis 14 of the cup 4 as viewed at each cross-section taken along the vertical axis 14. However, the present invention could be accomplished with all or any of the cross-sections of the sidewall 10 configured as an oval, square, or any other shape. Additionally, the sidewall 10 need not extend from the base 8 in a uniform manner. Rather, the sidewall 10 may comprise indentations and protrusions. The sidewall 10 could even be contoured to resemble the curvature of a human face, for example. So long as the sidewall 10 is associated with the base 8 in a manner which will allow the containment of a liquid, therein, the cup 4 is sufficient to allow the accomplishment of the instant invention.

A rim, 16 preferably, but not necessarily, extends from the sidewall 10 at an upper end 18, thereof, which forms the mouth 12 of the cup. The rim 16 preferably extends outward from the mouth 12 in the typical manner of a cup rim. The rim 16 allows a user thereof to more easily place a lip of the user's mouth under the rim 16. This ensures that if liquid is poured from the cup 4 into the user's mouth, the liquid will be properly poured into the user's mouth rather than being allowed to run down the sidewall 10 of the cup 4. Employing such a rim 16 on the cup 4 of the instant invention 2 allows those who wish to drink directly from the mouth 12 of the cup 4, rather than from the straw 6, to properly obtain a drink from the cup 4. However, the rim 16 is only a preferred embodiment and is not an essential portion of the cup 4 of the present invention. Other additions and/or modifications to the cup 4 as are known in the art are contemplated. All materials employed in the construction of the cups are also contemplated. These materials could be, by way of example only, styrofoam, paper, or a plastic.

Figure 3A:
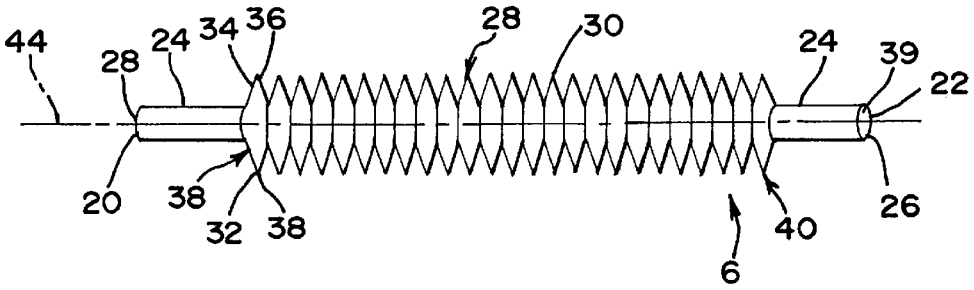
FIG. 3A depicts a front view of a preferred straw of the present invention.

The straw 6 of the present invention is preferably, although not necessarily, an accordion-type straw comprising at least one accordion section 28, thereon. The preferred straw 6 comprises a single accordion section 28 as depicted in FIG. 3A and described further hereinbelow. It should be noted that the present invention may be accomplished by any straw which will allow attachment to the cup 4 as described below. The preferred straw 6 comprises a first end 20 and an opposing second end 22. Each of the first and second ends 20, 22 comprise an outer perimeter 24 which is preferably consistent along the length, thereof, and an inner perimeter 26 which follows the contour of the outer perimeter 24. In this manner, each of the first and second ends are hollow to allow fluid transport therethrough. Indentations or other variations in the outer perimeters of the first and second ends 20, 22 are contemplated, so long as air or any liquid is not permitted to pass through the outer perimeter 24 of either the first end 20 or the second end 22.

The accordion section 28 of straw 6 preferably extends substantially from the first end 20 to the second end 22. The outer perimeter 30 of the accordion section 28 is comprised of a plurality of pleated sections 32. Each pleated section 32 comprises a first portion 34 and a second portion 36. A first end pleated section 38 is attached to the first end 20 of the straw 6. This is preferably accomplished by forming the first portion 34 of said first end pleated section 38 integrally with the first end 20. A second end pleated section 40 is attached to the second end 22 of the straw 6. This is preferably accomplished by forming the second portion 36 of the second end pleated section 40 integrally with the second end 22 of the straw 6. The remaining pleated sections 32 of the plurality of the pleated sections 32 are integrally connected along an axis 44 of the straw 6 to provide fluid connection of the first end 20 to said second end 22 of the straw 6. This is preferably accomplished by integrally forming each pleated section first portion 34 of the remaining pleated sections 32 to the respective adjacent pleated section second portion 36. The pleated section first portion 34 of the second end pleated portion 40 must also be integrally formed to the adjacent pleated section second portion 36. In this manner an enclosing wall is formed from the first end 20 to the second end 22 and an inner perimeter of the accordion section 28 is fluidly connected to the inner perimeter of each of the first and second end inner perimeter 26.

The above described configuration provides a straw through which either air or liquid may be suctioned without substantial loss of pressure due to leakage through the enclosing wall of the straw 6. The accordion section 28 of the straw 6 allows flexibility of the straw 6 such that it may be bent into a variety of forms while still allowing suction from the first end 20 to the second end 22. Additionally, the straw 6 may be extended or shortened by forcing the first and second ends 20, 22 of the straw 6 away from each other or toward each other, respectively, thus expanding or compressing the accordion sections 28. While all suitable materials and methods of manufacture known in the art are contemplated for construction of the straw 6 of the present invention, it is preferred that the present straw 6 be constructed by blow molding to minimize the costs of construction.

The lengths of the straw first and second ends 20, 22, and the accordion section 28 may vary without departing from the scope of the present invention. It is preferred that the first and second ends 20, 22, are of a length sufficient to allow a user of the straw 6 to place the user's lips, thereon, and obtain sufficient suction to allow drinking therethrough. However, it is contemplated that the straw first and second ends 20, 22, may be eliminated without preventing accomplishment of the present invention. Additionally, while straws are typically constructed to be of circular cross-section about the axis 44, thereof, other configurations are also contemplated.

Figure 3B:
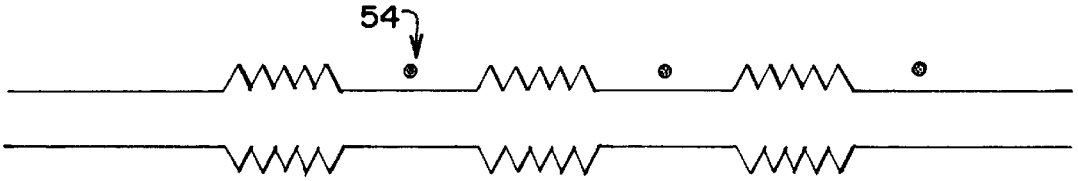
FIG. 3B depicts a front view of an alternative preferred straw of the present invention.

The straw 6 of the present invention may, in an alternative embodiment, comprise a plurality of accordion sections 28 each comprising at least one pleated section 38 as depicted in FIG. 3B. This alternative embodiment straw 6 provides the advantage of allowing bending, thereof, while reducing the material required for construction by elimination of some of the pleated sections 28, thereon. The alternative straw 6 thereby allows reduced construction costs. It should be recognized that while the remaining figures depict the straw 6 of FIG. 3A, the straw of FIG. 3B, or any other straw falling within the scope of the present invention, may be substituted therefor.

While various configurations of cups and straws have been previously known in the art, an inexpensive and efficient manner of configuring a cup and an associated straw for shipping and convenient use by a consumer have been, heretofore, unknown. The cup with the attached straw 6, in FIG. 1, of the present invention provides a simple, efficient, and convenient manner of providing a consumer with a cup 4, in FIG. 1, or, FIG. 4, and an associated straw 6 for use, therewith. This is accomplished by selectively attaching the straw 6 to the cup. In this preferred embodiment, the straw 6 is selectively attached to the outer perimeter 50 of the cup sidewall 10 adjacent to the cup mouth 12. When employing the preferred cup 4 of the present invention, the straw 6 is preferably but selectively attached immediately adjacent to the rim 16 of the cup 4. Placing the straw 6 adjacent to the sidewall upper end 18 allows easy access to the straw 6 by the consumer. Once holding the cup of the present invention 2, in FIG. 1, the consumer could grasp the straw 6 with the consumer's teeth or other hand to remove the straw 6 and place the straw 6 into the cup 4. It should be noted that employing a straw 6 with the accordion section 28 of the preferred embodiment allows for easy bending of the straw 6 around the outer perimeter 50 of the cup sidewall 10. Furthermore, the flexibility associated with a straw 6 comprising an accordion section 28 reduces the tendency of a straw 6 to straighten out and, thereby, detach itself from an associated cup 4.

Figure 4:
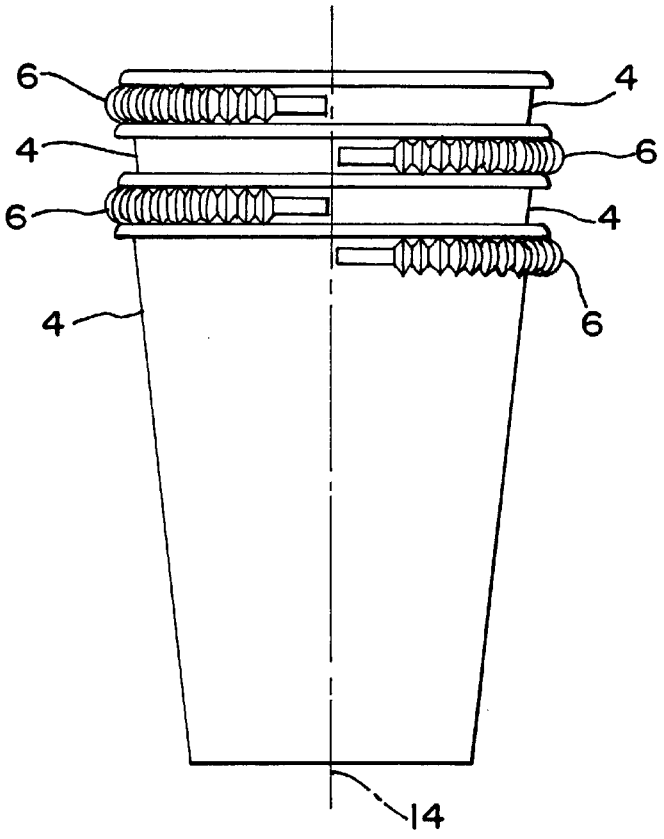
FIG. 4 depicts a front view of a stack of cups with attached straws of one embodiment of the present invention.

Fixation of the straw 6 adjacent to the sidewall upper end 18, furthermore, allows stacking of a plurality of cups of the present invention 2 for shipping or storage, as depicted in FIG. 4. In this stacked configuration, the sidewall upper end 18 of each cup 4 supports the next respective cup 4 resting, therein, by exerting a stabilizing force on the respective, sit selectively, attached straw 6. In this manner, cups 4, with or without rims, 16 may be stacked such that the sidewall upper end 18 supports the next upwardly adjacent cup 4.

However, it should be noted that when employing a straw which is shorter than an outer circumference 52 of the cup sidewall 10, around which the straw is selectively attached, a portion of each cup will not be supported by a stabilizing force, as discussed above. Therefore, stacks of the cups should preferably alternate the cups 4 such that the straw 6 of each cup 4 is not directly adjacent the straw 6 of the adjacent cups 4. Otherwise, an accumulation of the lack of a stabilizing force provided by the straw 6 might allow a large stack of cups of the present invention 2 to sway away from the stabilizing force provided by the straws 6 and topple a stack of cups of the present invention 2 (as shown in FIG. 4).

Although it is preferable that the straw 6 is attached to the cup 4 at a position adjacent to the mouth 12, thereof, (as depicted in FIGS. 1 and 4), the present invention 2 recognizes other placement of the straw 6 with respect to the cup 4. For example, the straw 6 could be attached atop the mouth 12 of the cup 4. The straw 6 could likewise be attached to the inner perimeter of the cup 4 and adjacent to the mouth 12 thereof. Also, the straw 6 could be attached to either the inner or outer perimeter of the cup 4 and located at any distance between the mouth 12 and the base 8—although positioning at approximately is seven-eighths (⅞) (depending on cup size) of the distance from the mouth 12 to the base 8 has been found beneficial, when stacking the cup with attached straw 6 in this configuration. Additionally, the straw 6 may be coiled and attached at either the interior or exterior of the base 8 of the cup 4.

It should become apparent that the present invention contemplates placement of the straw 6 at any position on the cup 4. However, those specifically mentioned above tend to better allow stacking of a plurality of the cups with the attached straw of the present invention.

Figures 5A, 5B, 5C:
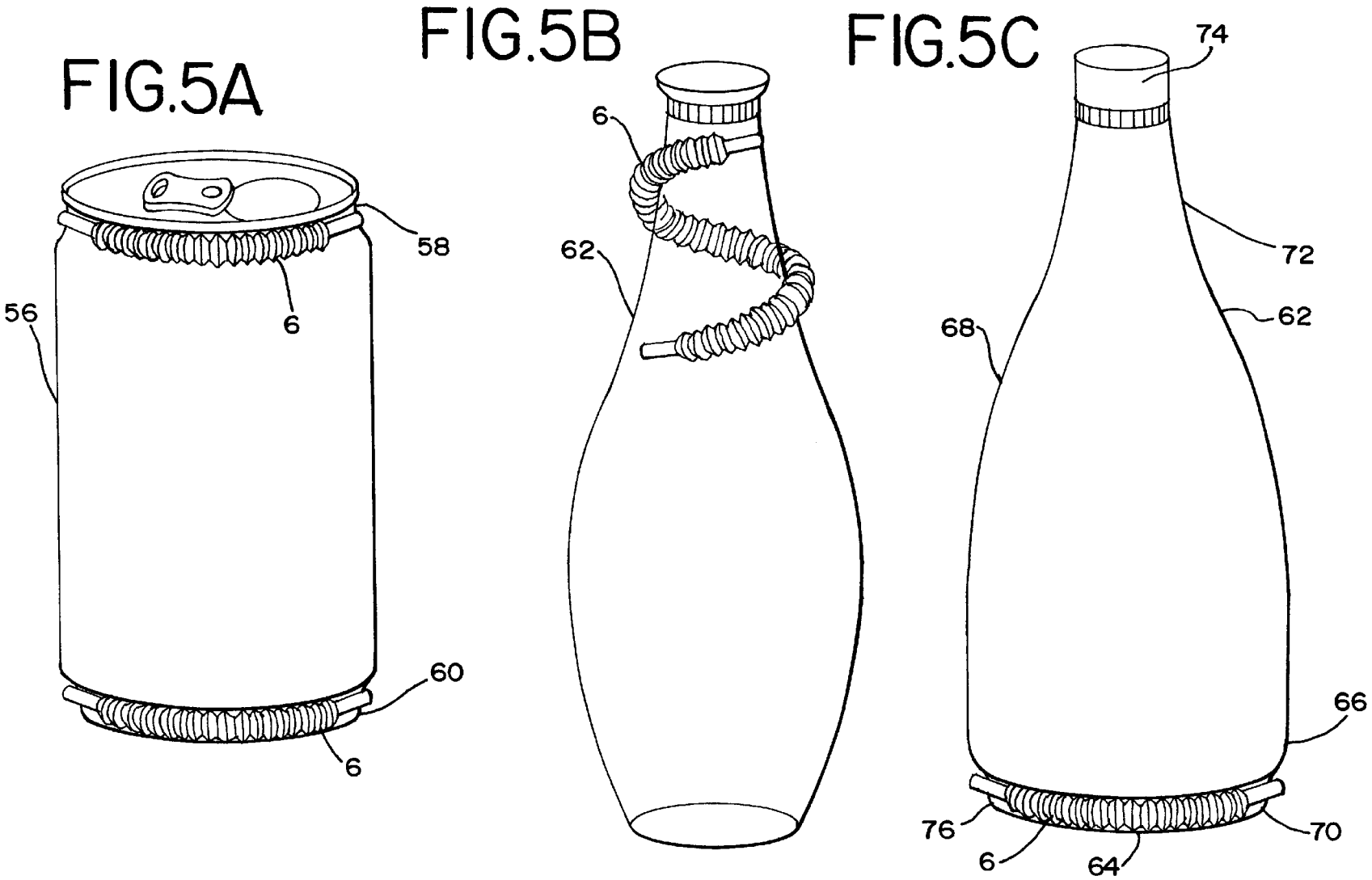
FIG. 5A depicts a can with straw of the present invention.
FIG. 5B depicts a bottle with straw of the present invention.
FIG. 5C depicts an alternative embodiment of a bottle with the straw of the present invention.

The present invention also contemplates uses with myriad containers aside from cups, including but not limited to cans and bottles (FIGS. 5A, 5B, and 5C). In FIG. 5C, a drink bottle 62 is employed for containing the liquid. The bottle 62 is defined by a base 76 having a flattened bottom 64 and sides 70 extending upwards perpendicular from said base 76. The bottle 62 is further defined by curving sidewalls 68 extending upwardly from the base 76. The curvature of the sidewalls 68 is convex so that said walls 68 define a decreasing circumference upwardly from the base 76 to a point after which the sidewalls 68 define a decreasing circumference upwardly through the neck 72 of the bottle 62 sufficient to fit a bottle cap 74 to be reversibly attached atop said neck 72 of the bottle 62. The straw 6 is attached via pressure sensitive adhesive 54 to the walls 70 of the base 76. Hence the straw 6 interferes very little with the overall size and shape of the bottle 62. The straw 6 may be preferably covered with a clear or opaque cellophane or plastic for sanitary purposes.

In an alternative embodiment, the straw 6 of each cup of the present invention 2 may be provided with a packaging (not shown) to keep dirt, debris, and germs from accumulating on the straw 6 and the cup 4. Likewise, the cup with attached straw may be packaged individually or in groups of cups with attached straws, thereby insuring that both the cup and the straw remain clean until ready for use by a user. Packaging of straws and/or cups or groups, thereof, may be accomplished by a sealed bag comprised of any known material or process for such packaging (e.g. shrink wrap). This may be especially beneficial to those persons who desire the cup and/or the straw of the present invention 2 to be new and clean for each use. Opening the packaging of either the cup or straw or both may be simplified by including a pull tab on the packaging. Other known methods of allowing easy opening of a packaging are also contemplated.

While the present invention has, heretofore, been described in the form of the straw 6 of the present invention attached to the cup 6, it is recognized that attachment of the straw of the present invention to other drinking containers may also accomplish the present invention. For example, FIG. 5A depicts a can 56 of the type typically used for beverages such as soda pop or beer and having a beveled upper and lower rim 58, 60. The straw 6 of the present invention may be releasably affixed at any position to the can 56 as described herein. However, to prevent the straw 6 from protruding from the exterior of the can 56, the straw 6 is preferably attached to either the upper or lower rim 58, 60. The drinking container of the present invention may also comprise a bottle as depicted in FIG. 5B. While the straw 6 may be affixed to the bottle 62 at any position, the coiled configuration of FIG. 5B is preferred.

Figure 6:
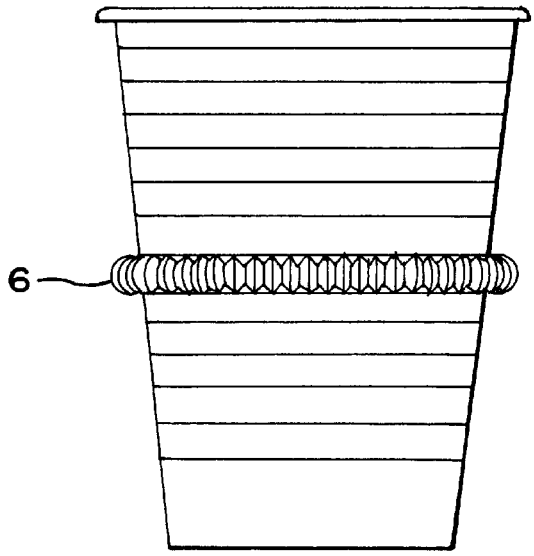
FIG. 6 depicts a front view of an alternative embodiment of the present invention.

In another alternative embodiment, the straw 6, or a printing thereon, may be aesthetically related to the cup 4 or other drinking container as described herein. For instance, and, as depicted in FIG. 6, the cup 4 may be printed with an American flag, thereon, and the straw 6 decorated to represent that one of the thirteen strips associated with the location of the straw 6 on the drinking container cup 4. In addition, or in the alternative, the straw 6 could cover a hidden message or picture (or a portion thereof) on the drinking container which would be displayed upon the removal of the straw 6 from said drinking container.

Attachment of the straw 6 to the cup 4, or other drinking container as described, herein, is preferably accomplished with a pressure sensitive adhesive 54. Pressure sensitive adhesive 54 is preferably placed on the cup 4 in a plurality of dots 54 as depicted in FIG. 2. It is recognized, however, that a continuous line of pressure sensitive adhesive 54 placed along the cup 4 may also accomplish proper selective attachment of the straw 6 to the cup 4. The straw 6 is pressed directly into the pressure sensitive adhesive 54. Alternatively, if the straw 6 is provided with a packaging, as discussed above, the packaging will be pressed directly into the pressure adhesive 54. In this configuration, the straw 6 packaging will then hold the straw 6 adjacent to the cup 4.

The pressure sensitive adhesive 54 must be strong enough to hold the straw 6 from falling or being accidentally knocked off of the cup 4 or other drinking container as described herein. For instance, the pressure sensitive adhesive 54 must be strong enough to hold up a stack of cups with the attached straw 6, (see FIG. 4), if the straw 6 is employed to provide an upward force to an adjacent cup 4, as discussed above. However, the pressure sensitive adhesive 54 must also allow a consumer to readily remove the straw 6 from the cup 4 to allow the use thereof.

To employ the present invention 2, (See FIG. 1) a consumer need merely grasp the cup 4, or other drinking container as described herein, pull the straw 6 from the cup 4, insert the straw 6 into the drinking container and suction the liquid into the consumer's mouth. If the straw 6 is packaged consistent with the above discussed embodiment, then the straw must be removed from the package prior to insertion of the straw into the liquid, if suction of the liquid into the consumer's mouth is to be accomplished. Additionally, when the straw 6, employing the accordion section 28, is employed, the straw 6 may be bent at any angle the consumer desires to accomplish drinking from the drinking container.

The forgoing specification describes only the preferred embodiments of the invention as shown. Other embodiments besides those presented above may be articulated as well. The terms and expressions, therefore, serve only to describe the invention by example only and not to limit the invention. It is expected that others will perceive differences which, while differing from the foregoing, do not depart from the spirit and scope of the invention herein described and claimed.

I claim:

1. A drinking system comprising:

a drinking container, said container having an indicia thereon; and a straw removably attached to said drinking container at a location, said straw having an indicia thereon;

wherein said indicia on said straw is congruent with said indicia on said cup; and wherein said location is such that said straw covers at least a portion of said indicia on said container.

2. The drinking system of claim 1, where said straw and said indicia on said container combine to form an overall indicia.

3. The drinking system of claim 1, where upon removal of said straw said covered portion of said container indicia is revealed.

* * * * *